US005878927A

United States Patent [19]

Ohzawa

[11] Patent Number: 5,878,927

[45] Date of Patent: Mar. 9, 1999

[54] DEVICE OF NECKTIE HOLDER FOR REMOVAL OF STAIN

[75] Inventor: Akira Ohzawa, Kyoto, Japan

[73] Assignee: Vegirl Co., Ltd., Kyoto, Japan

[21] Appl. No.: 917,508

[22] Filed: Aug. 26, 1997

[30] Foreign Application Priority Data

Oct. 18, 1996 [JP] Japan ..... 8-011434

[51] Int. Cl.[6] ..... D06C 15/00

[52] U.S. Cl. ..... 223/82; 223/81; 223/83; 223/84

[58] Field of Search ..... 223/82, 81, 83, 223/84, 65, 61, 63; 267/158, 164, 108

[56] References Cited

U.S. PATENT DOCUMENTS

| | | | |
|---|---|---|---|
| 399,447 | 3/1889 | Stiles | 267/164 |
| 4,428,437 | 1/1984 | Steinberg | 267/158 |
| 5,217,198 | 6/1993 | Samarov et al. | 267/164 |
| 5,368,358 | 11/1994 | Christensen | 267/158 |

FOREIGN PATENT DOCUMENTS

| | | | |
|---|---|---|---|
| 779984 | 1/1934 | France | 223/65 |
| 1002574 | 10/1946 | France | 223/82 |
| 993247 | 6/1949 | France | 223/82 |
| 52-99041 | 2/1997 | Japan . | |
| 168796 | 11/1920 | United Kingdom | 223/65 |

*Primary Examiner*—Bibhu Mohanty
*Attorney, Agent, or Firm*—Ronald R. Snider

[57] ABSTRACT

A necktie holder is used for removal of stains. The necktie is fitted with the holder and is maintained in a flat condition and in tight tension during stain removal procedures. The holder is also used as a hanger which maintains the necktie in the same condition until it is completely dried out. The holder comprises two pieces of wire rod and a flat leaf spring. Both ends of the leaf spring are bent, and a coupler is attached on the both bent ends. The coupler receives each end of the wire rods, each wire rod being turned around to produce a leaf spring loop condition for storing resilient power. The necktie is kept flat and in tight tension by the two wire rods empowered with stored resilience of the leaf spring.

6 Claims, 7 Drawing Sheets

DEVICE OF NECKTIE HOLDER FOR REMOVAL OF STAIN

RELATED APPLICATION

This present disclosure relates to subject matter contained in Japanese Utility Model Application No.8-11434 (Filed on Oct. 18, 1996) which is expressly incorporated herein by reference in its entirety.

BACKGROUND OF THE INVENTION

This invention relates to a device of a necktie holder for removal of stain, wherein a stain or a spot clogged on a necktie can be removed while the device is applied as a hanger to maintain the necktie extended in a tight tension. The device is also used as a drying utensil for holding the necktie with the device.

In the prior art, in order to remove a stain on a necktie, the necktie is generally extended in a flat condition, and stained portions are removed manually. The stained portions are tapped or scrubbed with a cloth or the like soaked with detergent. This removal procedure has not been satisfactory, because some spreading of the stain has been unavoidable.

SUMMARY OF THE INVENTION

This invention has an object to provide a necktie holder device for removal of stain, wherein any person in his own home as well as in a professional laundry shop can remove clogged stain from a necktie.

The present invention has another object to provide a hanger, wherein the holder is inserted into the necktie from the bottom so that the necktie can be kept in a flat and tight tension during the step of stain removal.

In order to achieve said objects, the invention has adopted the following constitution. The necktie holder developed by this invention comprises two wire rods and a flat leaf spring. Both ends of the leaf spring are adapted to be bent extending toward at a wide and open angle like a trapezoid shape. The ends of two couplers are constructed each to receive each rod. One end of the wire rod is fixedly inserted into the coupler, and then the two rods are forcibly turned round toward an opposite position. Through this forcible rotation the leaf spring provides a loop condition which stores a resilient power by spring tension. Thus, when the holder is inserted into the necktie from its bottom, the stored power is released to maintain the held necktie in flat and tight tension.

On the other hand, another coupler is separately developed. This coupler has a first aperture on one end and has also a second aperture on other end. The first aperture receives a bent end of the leaf spring while the second aperture receives the end of the rod. When the bent end of the leaf spring and the end of the rod are inserted fixedly into each designated aperture of the coupler respectively on both portions, the present invention is achieved.

BRIEF DESCRIPTIONS OF THE DRAWINGS

FIG. 1*a* is a side view of a leaf spring developed by the present invention.

FIG. 1*b* is a plan view of wire rods developed by this invention.

FIG. 2 is a partial perspective view of the leaf spring attached with a coupler.

FIG. 3*a* is a side view of device of a necktie holder wherein two wire rods are inserted into each coupler on both sides.

FIG. 3*b* is a side view of the holder wherein the two rods are turned round to provide a loop condition above.

Figures 9A, 9B, 9C:
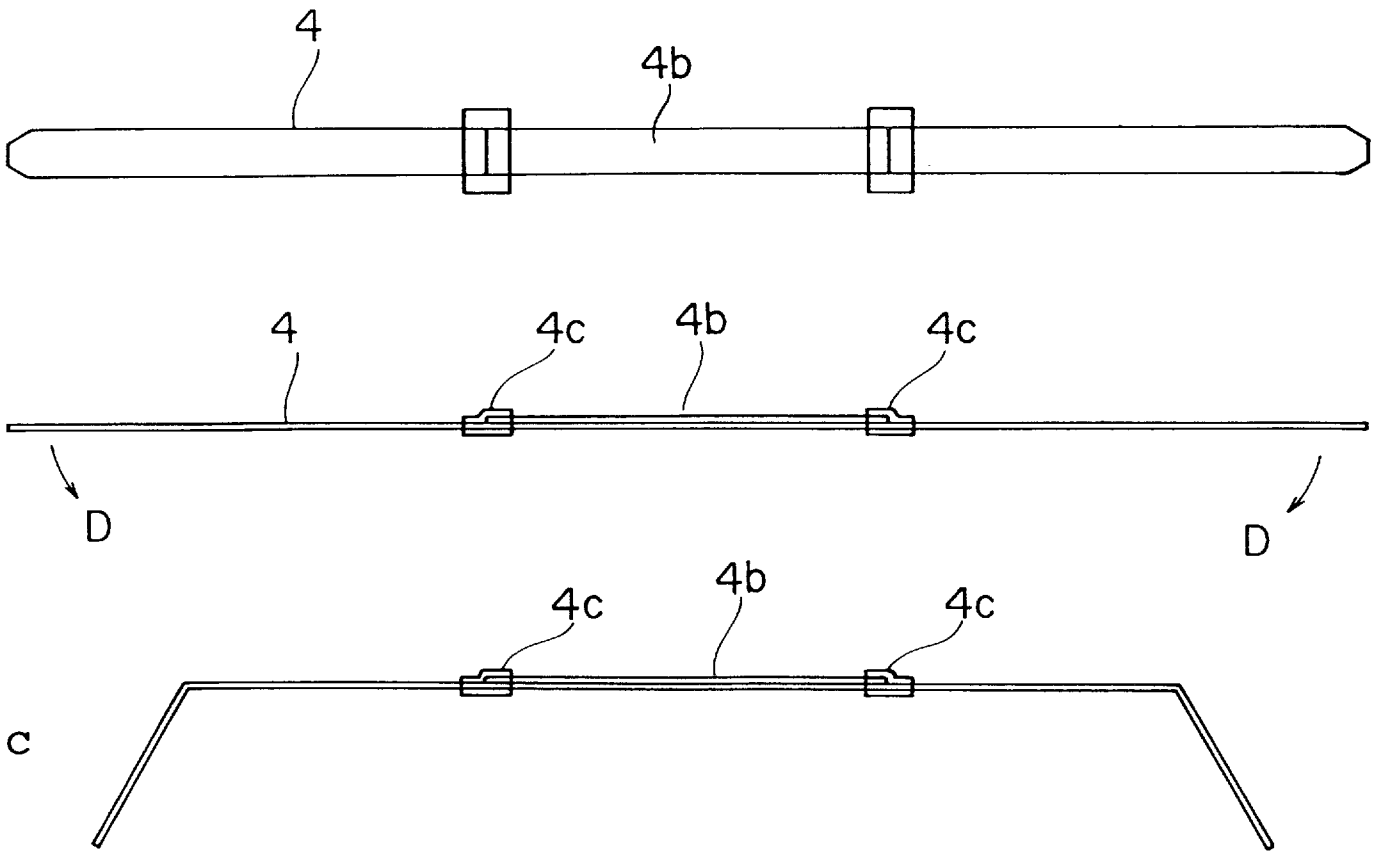

FIG. 9*a* is a plan view of the leaf spring before bending.

FIG. 9*b* is a side view of FIG. 9*a*.

FIG. 9*c* is a side view of the leaf spring with both ends bent.

DESCRIPTIONS OF THE PREFERRED EMBODIMENT

The preferred and actual embodiment is now described with reference to attached drawings.

EXAMPLE 1

Figure 1A:
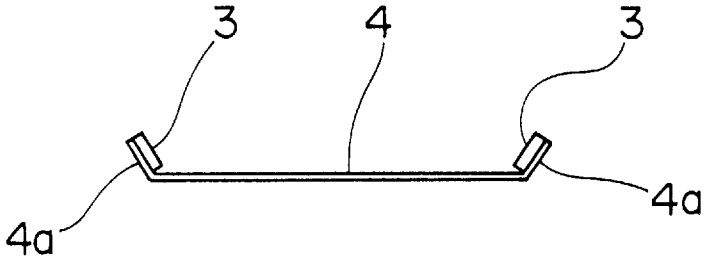
Figure 1B:
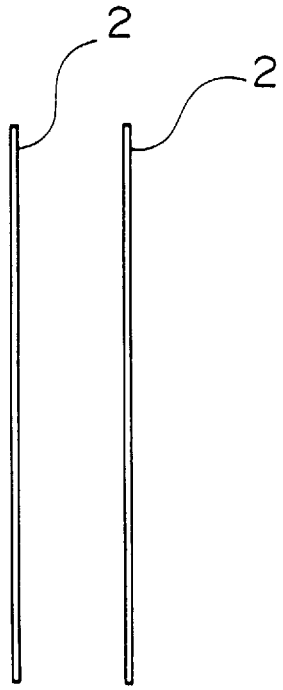
Figure 2:
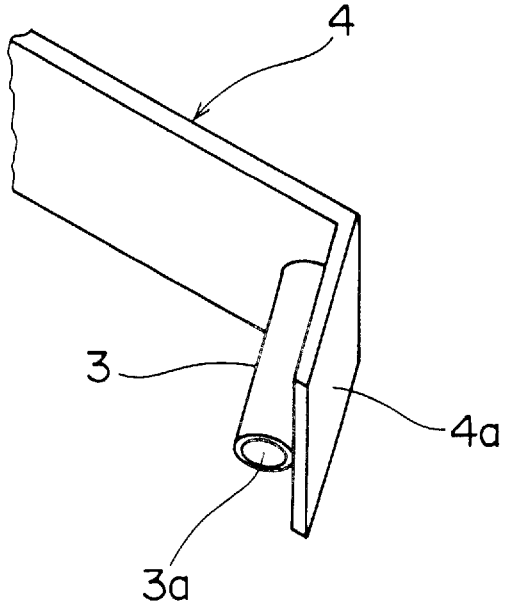
Figure 3A:
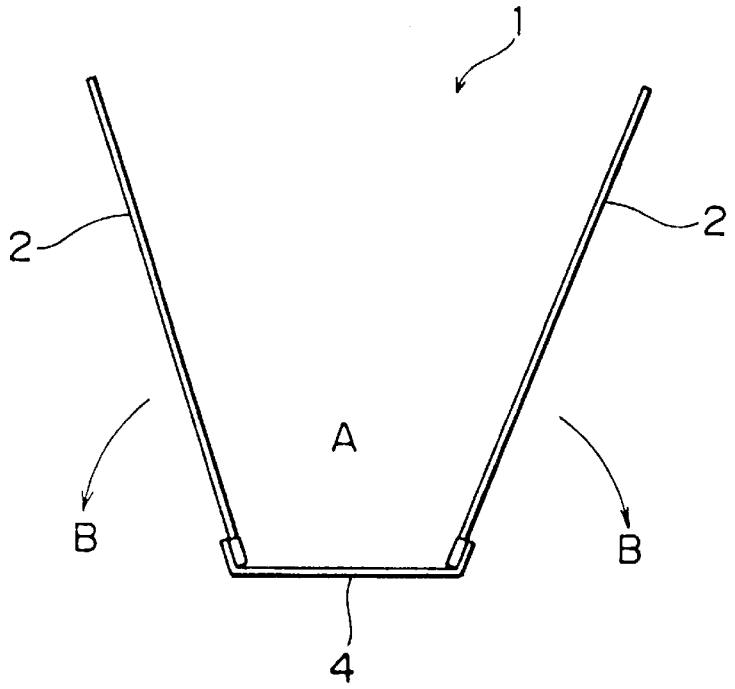
Figure 3B:
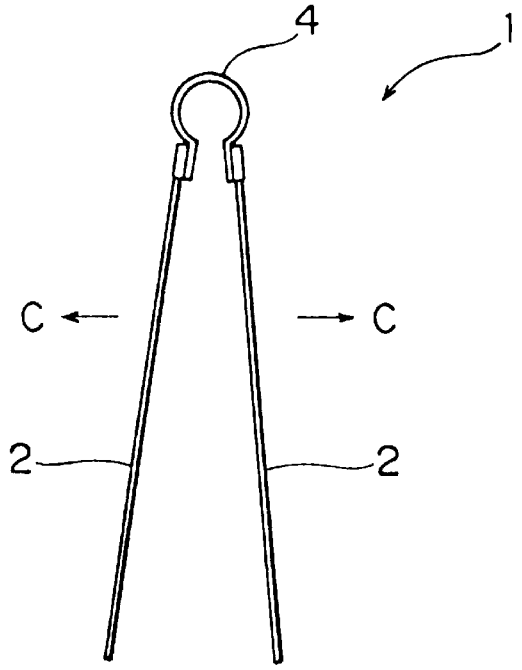
Figure 4:
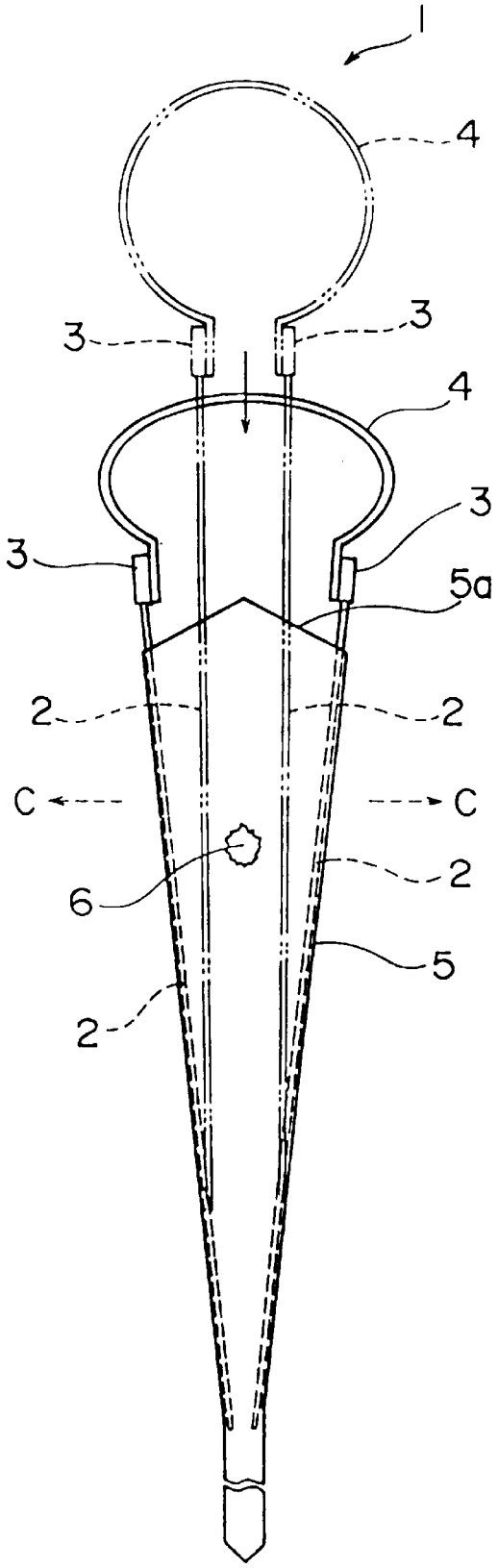
FIG. 4 is an explanatory view to show insertion of the holder into a necktie.
Figure 5:
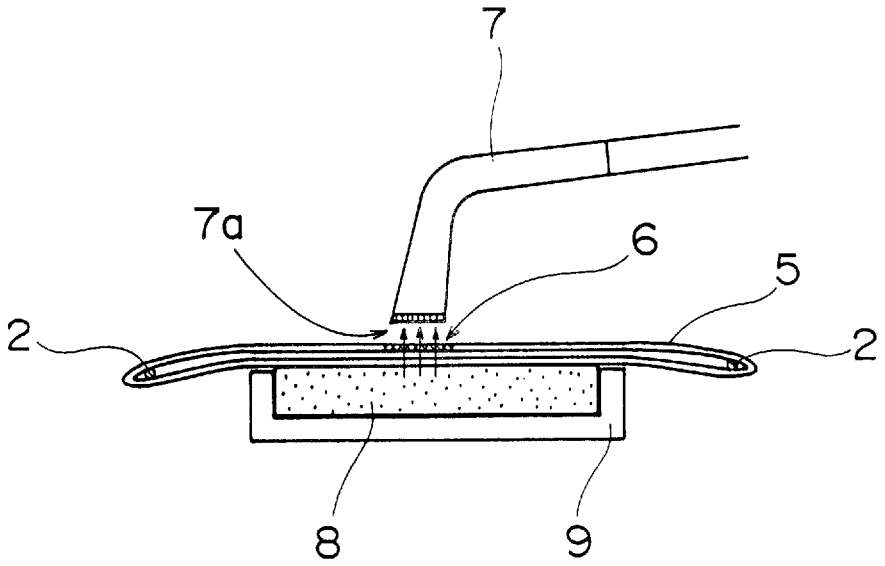
FIG. 5 is a sectional view showing how to remove a stain.

FIG. 1*a* is a side view of a leaf spring and FIG. 1*b* is a plan view of wire rods, both of which show fundamental materials which comprise a device of a necktie holder for removal of stain. FIG. 2 is a perspective view of the leaf spring where a coupler is attached. FIG. 3*a* and FIG. 3*b* explain assembly of this holder, while FIG. 4 shows the holder inserted to maintain the necktie. FIG. 5 is a sectional view explaining how to perform stain removal. In these figures, the numeral 1 is a necktie holder, which comprises two wire rods (2) and a leaf spring (4). Both ends (4*a*) of the leaf spring (4) are adapted to be bent at a wide and open angle like a trapezoid shape so that inner surfaces of each end (4*a*) face each other, and on the surfaces of spring, a pair of piping couplers (3) with apertures (3*a*) are fixedly established. The aperture (3*a*) each receives one end of a wire rod (2). The numeral 5 is a necktie, and the numeral 5*a* is a bottom mouth of the necktie (5), from which the holder (1) is inserted, while the numeral 6 is a stain clogged on the necktie.

With reference to FIG. 3, the ends of two rods (2) are respectively inserted into the apertures (3*a*) of the couplers (3). According to FIG. 3*a*, both ends (4*a*) of the leaf spring (4) face each other toward their inside, in other words, each end (4*a*) extends in the "A" direction. When the rods (2) are forcibly turned round toward the opposite position, namely, toward the "B" direction, the leaf spring (4) is curved to produce a loop condition as shown in FIG. 3*b*. After this forcible rotation,each end (4*a*) faces outward. Accordingly, as shown in FIG. 3*b*, resilient power is stored forcing arms outward, namely toward the "C" direction.

With reference to FIG. 4, width between two rods (2) is kept same as or a little bit narrower than the width of the bottom mouth (5*a*) of the necktie (5), and the rods (2) are inserted from the mouth (5*a*), and thus the rods are gradually inserted deep along the lapels of the necktie (5), so that the necktie (5) is now fitted with the holder (1).

According to FIG. 4, as the resilient power is stored toward the "C" direction, the two rods (2) tend to extend outward when the necktie (5) is fitted with the holder (1) in the condition that the rods (2) lie along the lapels of the necktie (5). The resilient power stretches the front surface of the necktie (5), wherein the necktie (5) is in a flat condition with a tight tension so that the stain (6) clogged on the necktie (5) is correctly exposed without any wrinkle.

Now, actual operation of stain removal is explained.

With reference to FIG. 5, the numeral 7 is a nozzle to suck the stain (6) from the necktie (5) and water from sponge. This nozzle (7) is connected to a suction absorbing mouth of a household vacuum cleaner so that suction power is effected on an end (7*a*) of the nozzle (7). A wire netting grate is equipped at this end (7*a*) in order to avoid sucking of the whole necktie therein. The numeral 8 is a sponge including water in a container (9).

After the necktie is fitted with the holder (1), the stained portion (6) of the necktie is placed over the sponge (8) including water in the container (9), and then a detergent is fully soaked into the stained portion (6) of the necktie (5). Next, the end (7*a*) of the nozzle (7) is contacted on the stained portion (6) and the vacuum (not shown in the drawing) is operated. This operation sucks the water included in the sponge (8) through the stained portion (6). Thus, the stain (6) in the fiber is dissolved with the water and it is removed by the suction, which removes the stain (6) on the necktie (5) without incurring spreading of the stain.

When this stain removal is finished, the necktie (5) in wet condition is dried on a drying stand using the loop portion of the holder (1). The necktie (5) is kept in tight tension during this drying procedure, whereas the necktie (5) is finally obtained without any wrinkle through this procedure.

During the application of this holder (1), the leaf spring or other metal piece may hurt human hands. In order to avoid this kind of accident, it is advisable to cover the spring (4) including the coupler (3) with flexible synthetic resin, for example, an elastomer, so that safety device can be provided.

At the same time, with regard to the rod (2), retractable rod material can be adopted for the same, so that compactness for carrying may be obtained. Also, the coupler (3) can be connected with the leaf spring by screwing device.

EXAMPLE 2

Figure 6:
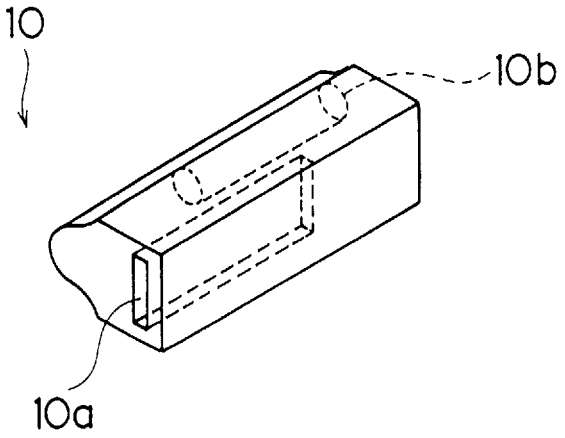
FIG. 6 is a perspective view of a second embodiment of the coupler.

FIG. 6 shows a perspective view of another coupler (10) to be used for a device of a necktie holder for removal of stain. In this second embodiment, the coupler (10) has a first aperture (10*a*) on one end, and it has also a second aperture (10*b*) on the other end. The first aperture (10*a*) is formed at the first end of the coupler (10) and extends toward the other end of the coupler (10), while, on the contrary, the second aperture (10*b*) is formed at the other end of the coupler (10) and extends toward the first end of the coupler (10). The bent end (4*a*) of the leaf spring (4) is inserted into the first aperture (10*a*), while one end of the rod (2) is to be inserted into the second aperture (10*b*). When the bent end (4*a*) and the rod (2) are both inserted fixedly into their designated apertures (10*a* and 10*b*) respectively, this second embodiment is performed to complete the device of the necktie holder (1) for removal of clogged stain.

EXAMPLE 3

Figure 7:
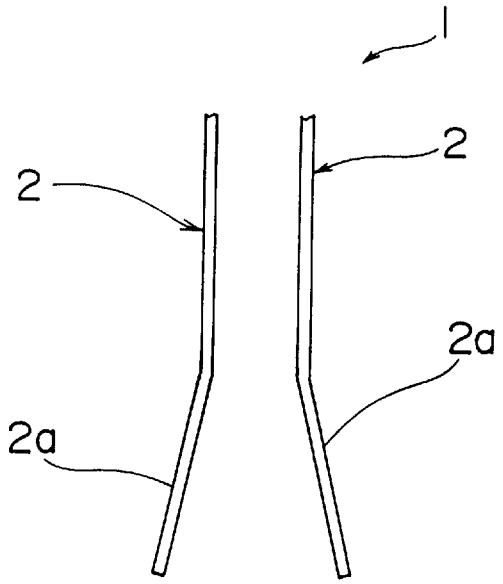
FIG. 7 is a side view of a third embodiment of wire rods in slightly curved condition.
Figure 8:
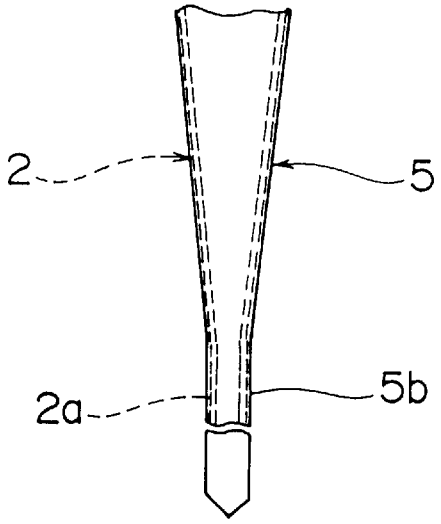
FIG. 8 is an explanatory view showing an embodiment condition of FIG. 7.

With reference to FIG. 7 and FIG. 8, a third embodiment is now described. This embodiment is applicable for a necktie which is gradually widened toward its bottom.

FIG. 7 shows a preferred style of a wire rod (2), wherein the end portion (2*a*) of the rod (2) is adapted to be slightly curved outside. FIG. 8 explains the condition in which the necktie (2) is fitted with a holder (1). According to FIG. 7, the end portion (2*a*) of the rod (2) is slightly curved toward its outside. By this device, resilient power is imposed evenly against the necktie (5). According to FIG. 8, when the necktie (5) is fitted with the holder (1), the end portion (2*a*) of the rod (2) enters upto the narrowest portion (5*b*) of the necktie (5). Thus, the width of the narrowest portion (5*b*) can be extended in a flat under tight tension, and maintained in this condition.

The present necktie holder (1) developed by this invention can be of course adopted for professional and business shops.

Further, the fundamental construction or fundamental procedures to obtain the present holder (1) are now described as below.

FIG. 9*a* is a plan view of a leaf spring (4) before being bent, and FIG. 9*b* is a side view of this FIG. 9*a*, while FIG. 9*c* is a side view of the leaf spring (4) with both ends bent. With reference to FIG. 9*a*, the basic material of the leaf spring (4) is shown and it has a size of 300 mm long, 10 mm wide, and 0.5 mm thick, and both ends of the spring (4) are cut off at 5 mm from its top end at 45 degrees. Referring to FIG. 9*b*, a reinforcing leaf spring (4*b*) having a size of 90 mm long, 10 mm wide, and 0.5 mm thick is placed on the middle portion of this basic spring (4), namely at a distance of 105 mm from the top end, and then the reinforcing spring (4*b*) is fixedly and tightly attached to the basic spring (4) with a cylindrical spacer (4*c*), and thus the combined leaf spring with 300 mm long is provided. With reference to FIG. 9*b* and 9*c*, both ends of the combined leaf spring are adapted to be bent toward the opposite side of the attached reinforce spring (4*b*) at the distance of 40 mm from the top end at an angle 60 degrees. The additional reinforcing leaf spring (4*b*) used above is for increasing resilient power.

Then, in reference with FIG. 2, as a coupler (3), a metal pipe with a size of 30 mm long with inner diameter of 2.67 mm is welded on the bent end portion (4*a*) of the leaf spring (4), and the whole spring (4) is covered with an elastomer which does not close an aperture (3*a*) of the coupler (3).

As the material of the rod (2), brass rod with a size of 730 mm long with diameter of 2. 5 mm is adopted.

The instant invention provides a necktie holder for removal of stain, wherein the necktie is constantly maintained in a flat and tight tension during the stain removal procedure and moreover even after this removal procedures the holder can be applied on the drying stand in the succeeding condition, which is not known in the prior art. It is firmly believed this invention provides benefits in home use as well as in professional use.

It is further understood by those skilled in the art that the foregoing description is a preferred embodiment of the disclosed invention and that various changes and modifications may be made in the invention without departing from the spirit and scope thereof.

What is claimed is:

1. A necktie holder for removal of stain which comprises:

a flat leaf spring having two ends, wherein each of said two ends is bent to form an upward wide open angle;

two couplers attached to said two ends of said flat leaf spring; and two wire rods having two first ends and two second ends, said two first ends of said two wire rods being inserted into said two couplers;

wherein said two second ends of said wire rods are bent in an opposite direction to said upward wide open angle of said flat leaf spring to form the necktie holder, wherein said flat leaf spring is turned into a loop by resilient power generated by bending said wire rods toward the opposite direction of said upward wide open angle of said flat leaf spring.

2. The necktie holder for removal of stain according to claim 1, each of said couplers further comprising a first aperture and second aperture, said first aperture receiving said flat leaf spring and said second aperture receiving said wire rods.

3. The necktie holder for removal of stain according to claim 1, wherein said flat leaf spring including said couplers is covered with a flexible synthetic resin.

4. The necktie holder for removal of stain according to claim 1, wherein said couplers are attached to said flat leaf spring by a screwing device.

5. The necktie holder for removal of stain according to claim 1, wherein each of said wire rods has an end portion which is slightly and outwardly curved.

6. The necktie holder for removal of stain according to claim 1, said leaf spring further comprising a reinforcing spring to be attached to a middle portion of said flat leaf spring.

* * * * *